US006871044B2

(12) United States Patent
Chadwick

(10) Patent No.: US 6,871,044 B2
(45) Date of Patent: Mar. 22, 2005

(54) EXCITER SYSTEM AND METHOD FOR COMMUNICATIONS WITHIN AN ENCLOSED SPACE

(75) Inventor: George G. Chadwick, Menlo Park, CA (US)

(73) Assignee: Cocomo MB Communications, Inc., Tokyo (JP)

( * ) Notice: Subject to any disclaimer, the term of this patent is extended or adjusted under 35 U.S.C. 154(b) by 688 days.

(21) Appl. No.: 09/909,246

(22) Filed: Oct. 1, 2001

(65) Prior Publication Data

US 2002/0028653 A1 Mar. 7, 2002

Related U.S. Application Data

(63) Continuation-in-part of application No. 09/340,218, filed on Jun. 25, 1999.

(51) Int. Cl.[7] ..... H04H 1/00

(52) U.S. Cl. ..... 455/3.01; 455/3.06; 455/41.1; 455/41.2; 343/904

(58) Field of Search ..... 455/3.01, 9, 523, 455/41.1, 41.2, 3.06, 3.05, 41.3; 340/505; 343/904; 342/22

(56) References Cited

U.S. PATENT DOCUMENTS 3,400,221 A * 9/1968 Wolters ..... 455/3.06
4,743,916 A * 5/1988 Bengeult ..... 343/785
5,416,452 A * 5/1995 Noerpel et al. ..... 333/113
5,994,984 A * 11/1999 Stancil et al. ..... 333/248
6,329,928 B1 * 12/2001 Hershey ..... 340/870.07
6,336,031 B1 * 1/2002 Schyndel ..... 455/41.2
6,512,431 B2 * 1/2003 Pergande ..... 333/246

* cited by examiner

*Primary Examiner*—Lee Nguyen
*Assistant Examiner*—Lewis G. West
(74) *Attorney, Agent, or Firm*—Michael J. Hughes; Intellectual Property Law Offices

(57) ABSTRACT

An exciter system (10) is provided for use in facilitating electromagnetic communication within an enclosed space (12). The system (10) includes an exciter (26) which may be in the form of a three dimensional hemispherical exciter (28) or a two dimensional planar sector exciter (30) depending on the size of the associated structure and the power requirements of operation. The exciter system (10) operates in conjunction with a hub/controller network (44). The exciter system (10) is adapted to induce a quasi-static evanescent field (20) within the space and to thereby enable communications using the evanescent field (20) at frequencies within an operational frequency range determined by the characteristics of the space. The exciter (26) is mounted in opposition to a portion of a conductive framework (18) within the enclosed space, and is separated therefrom. In operation, a coaxial connector (48) connects the exciter (26) to the hub/controller network (44) with the center conductor (50) connecting at a feed point (66) to the exciter (26) while the shield conductor (52) is connected to the opposing conductive framework (18). In some embodiments a post (40) acts as a curtain to enhance performance at lower frequencies.

20 Claims, 7 Drawing Sheets

EXCITER SYSTEM AND METHOD FOR COMMUNICATIONS WITHIN AN ENCLOSED SPACE

CROSS-REFERENCE TO A RELATED PATENT APPLICATION

The present application is a Continuation-In-Part Patent Application, and the Inventor claims the benefit of priority for all subject matter commonly disclosed in the present patent application and in parent patent application Electromagnetic Communication System for Wireless Networks, filed on Jun. 25, 1999 and assigned U.S. Ser. No. 09/340,218.

This application is also related to a United States patent application entitled Hub and Probe System and Method being filed concurrently with the present application and which is incorporated by reference in its entirety for all purposes.

TECHNICAL FIELD

The present invention relates generally to wireless communications, and more particularly to systems for internal communications within structures, particularly at frequencies in the range of 0.5 to 100 MHz.

BACKGROUND ART

Communications within buildings and other enclosed spaces have long presented problems. Communication wiring, such as for local area networks, is effective but suffers from problems with installation costs, limitations on connection locations and the need for periodic upgrading when technology advances. Metallic structural members, interior furniture, plumbing and electrical wiring all have a tendency to interfere with conventional wireless communications. Outside interference, such as galactic noise and human generated electromagnetic sources also frequently interferes with the quality and efficiency of in-building communications.

As described in the inventors prior application, a neglected frequency band in the electromagnetic spectrum, at least from the standpoint of communication utilization, is that in the 0.5–100 MHz range. Much of this range is traditionally considered to be less than useful, and is accordingly less regulated by government entities. An example of this in the United States is that Part 15 of the FCC Rules apply in this range. One reason that this range is not widely utilized is that the waveforms have sufficiently long wavelengths that structural interference affects transmission and reception. However, with the inventor's technology it has become possible to harness this range of frequencies and to turn the factors which have been hindrances into advantages.

An area of electromagnetic phenomena which has been little understood and utilized traditionally is that dealing with evanescent (non-propagating) waves. Commercial utilization of these phenomena have been rare. The phenomena are known and observed in waveguide technology, but are ordinarily a hindrance, and limit the utility of structure near what is known as "cut-off".

Cut-off occurs for conventional propagation in hollow pipe waveguides when the size of the hollow pipe waveguide is less than one-half (½) of the wavelength at the operating frequency. When these conditions obtain, the transmission losses are very high but not infinite. The expression for attenuation below cut-off in ideal waveguides, Equation 1, may be written:

$$\gamma=2\pi/\lambda_c\sqrt{1-(f/f_c)^2} \quad (1)$$

where:

$\gamma$=attenuation $\lambda_c$=cut-off wavelength $f$=operating frequency $f_c$=operating frequency at cut-off where the wavelength, $f$, is approximately equal to 11.8/$f$(GHz) in inches.

As f is decreased below $f_c$, $\gamma$ increases from a value of 0 approaching the constant value of $2\pi/\lambda_c$, when $(f/f_c)^2<<1$.

The amount of attenuation is determined only by the cut-off wavelength of the waveguide, which is in general proportional to the transverse size of the waveguide, so that the value of $\gamma$ may be made almost as large as one pleases by selecting a low cut-off wavelength (small pipe size). Since (1) holds for any wave in any shape of guide, it follows that choices of wave type and guide shape cannot influence the attenuation constant except in so far as they fix the cut-off wavelength $\lambda_c$ {"Fields and Waves in Modem Radio", Simon Ramo and John Whinney, pg 386–387, dated May 1956)

Wave motion, forming the core of many subjects in physics, is a prominent (interdisciplinary) topic in many textbooks. (ON EVANESCENT WAVES, A. Stahlhofen and H. Druxes, Univ. Koblenz, Inst. F. Physik, Rheinau 1, D-56075 Koblenz, Germany) While traditional wave motion is often dealt with in great detail (for good reasons), the theory of evanescent waves is often only mentioned in passing.

Such small mention is by no means justified: evanescent waves—originally indeed introduced as convenient mathematical tools having no application in mind (Bryndahl, O., "Evanescent waves im optical imaging", in *progres in Optics,* American Elsevier Publishing Co, New York 1973, pp 169–221 and Hupert, J. J., *Appl. Phys.* 6 1975 pp 131–149)—matured in the last decades to a topic of its own intrinsic interest finding a steadily increasing number of applications in basic as well as applied research and in industry. Any propagating wave is converted into an evanescent wave when hitting a classically forbidden region (below cut-off). In this case, at least one component of the wave vector becomes imaginary or a complex value and the wave experiences exponential damping when operating in this region (the cut-off effect described above). Such waves are used as diagnostic tools in many contexts involving waveguides; applications range from diverse areas of solid state physics and microwave-technologies. Explicit examples show that evanescent waves play an important role in microwaves, optics, and quantum mechanics. Despite the fact that all of these systems are governed by different wave-equations, different dispersion laws, different energy regimes and completely different structures and sizes, wave motion in the respective systems under consideration often involves evanescent waves.

The typical mechanisms accounting for the existence of evanescent waves are: 1) conversion into other forms of energy in lossy media, 2) cut-off modes in certain directions resulting from reflections in lossless media, 3) gradual leakage of energy from certain guiding structures and 4) mode conversion produced by obstacles or by changes in guiding structures.

Evanescent waves have some peculiar properties sometimes defying intuition. As a typical example the fact was mentioned that they operate in the forbidden region (below cut-off) experiencing exponential damping. Wave motion involving evanescent waves is easily demonstrated with electromagnetic waves using microwaves.

It is now established that electromagnetic connectivity can be achieved by the use of evanescent non-propagating waves below cut-off or propagating waves above frequency cut-off. Some methodology must be developed which can inject currents into the metallic elements of a structure in order that evanescent waves be generated in the cut-off region. For frequencies above the cut-off region more traditional antenna technologies can be used.

Although the phenomena relating to evanescent waves and other wave characteristics resulting at wavelengths below or near cut-off regions are known, they have not heretofore been meaningfully commercially utilized. In general, these phenomena are considered to be hindrances and nuisances, rather than opportunities for actually enhancing communications. In this light, there remain many opportunities for utilization and improvement, to be addressed by the present invention and the Inventor's related inventions.

SUMMARY OF THE INVENTION

Accordingly, it is an object of the present invention to utilize the characteristics of electromagnetic energy in frequencies which produce evanescent waves, and in near cut-off frequencies, to provide a medium for effective communication within structures.

It is another object of the present invention to provide a structurally contained wireless communication system where energy external to the structure is minimized.

It is a further object of the invention to provide easily installed and utilized exciter components which can be adapted for use in existing conventional structures.

It is yet another object of the invention to provide for exciter structures and systems which are appropriate for different types and sizes of structures.

It is still another object of the present invention to provide a configuration which allows weak signals generated within a structure to be carried through the conductive framework of the structure to a location where such signals can be received and processed.

Briefly, a preferred embodiment of the present invention is an exciter system for energizing and operating with the Electromagnetic Field Communications System for Wireless Networks. This is a wireless technology scheme which allows wireless communication within a structure. In a typical residential, commercial or industrial building, the exciter performs the function of exciting the conductive framework, formed of metallic elements existing within the walls of the structure, whether they be electrical wires, metal walls, plumbing or any combination thereof. This wireless system is initiated by a hub and controller network which is connected to, and drives the exciter. The exciter in turn energizes the conductive framework in the building walls for use by any number of remote wireless receivers situated within the structure. In addition, the exciter configuration permits reception of signals generated by other devices within the building. Even though such signals would otherwise be far too weak for normal reception, the unique qualities of the exciter with respect to the conductive framework facilitates communications. The basis for this technology is disclosed and contained in the inventor's U.S. patent application entitled Electromagnetic Field Communications System for Wireless Networks, Ser. No. 09/340,218, filed Jun. 25, 1999. The hub and controller network along with the exciter allows a complete wireless system to operate within a structure that would otherwise not be possible. The technology uses the metallic elements within the walls to create the evanescent modes which also inhibits radiation from within the structure to the outside, and prevents galactic noise from penetrating into the structure.

It is now established that electromagnetic connectivity can be achieved by the use of evanescent non-propagating waves below cut-off or propagating waves above frequency cut-off. The inventor's methodology can inject currents into the conductive metallic elements of a structure in order that evanescent waves be generated in the cut-off region. For frequencies above the cut-off region more traditional antenna technologies can be used.

Observations and measurements made by the inventor are consistent with a view of the operation of one aspect of the exciter invention as creating a non-propagating "field" of evanescent waves throughout the excited building structure. This field operates at any one or more of a frequencies within a specific range, all of which are at or below the cut-off frequency which is established for the space. This field then acts in a manner analogous to a carrier wave and may be modulated in order to deliver signals on such frequencies throughout the building.

The preferred embodiments involve specific exciter examples adapted to achieve broad bandwidth and to approximately match the coupling of energy into a structure. One preferred embodiment is adapted for a larger commercial or industrial structure and a second preferred embodiment adapted for a typical residence. The specific location and installation of the exciter component, and to a lesser degree the design of the exciter for a particular structure are somewhat unique to the characteristics of that structure and must, at least to some degree, be empirically determined. There are several design guidelines that can be followed to expedite an efficient design. The exciter should have; 1) a diameter less than $\lambda/8$ (at the highest operating frequency), 2) be mounted less than $\lambda/8$ (at the highest operating frequency) from the conducting wall element, and 3) be approximately centered between the floor and the ceiling. An exciter must have sufficient size to establish a measureable shunt reactance to the incoming transmission line (i.e., at most 25% of the characteristic transmission line impedance). This logic applies to the evanescent portion of the frequency band.

Once the proper exciter size and design has been selected and situated within a given structure, it is then controlled by a hub controller network to be excited over a range of frequencies and to accordingly set up the waveforms within the conductive framework. Receivers or probes situated at nearly any point in reasonable proximity to the conductive framework within the structure can then, in a wireless fashion, receive communications through the established waveforms.

An advantage of the present invention is that it provides a way to activate an effective communications bubble which minimizes interference from outside sources, such as galactic noise.

Another advantage is that the exciter has sufficient controllable bandwidth that it can be used to minimize interference between various network segments.

A further advantage of the present system is that it can provide contiguous bandwidth from 0.5 MHz to the cutoff frequency defined by the building structure or rooms for evanescent waves and provides additional contiguous bandwidth to and above 100 MHz for propagating waves.

Yet another advantage of the invention is that it uses the size of a structure to eliminate the need for very large antennas.

Still another advantage of the system is that low power remote unit "probes" can be used to couple with the conductive framework of the building in order to transmit signals back to the central hub system, with the unique relationship of the exciter system to the conductive framework allowing reception of such weak signals.

A still further advantage of the present invention is that the exciter component can serve multiple functions and eliminate the need for separate antenna-like components.

Another advantage of the present invention is that the exciter component is physically compact in structure and can be installed and become operational very quickly.

These and other objects and advantages of the present invention will become clear to those skilled in the art in view of the description of the best presently known mode of carrying out the invention and the industrial applicability of the preferred embodiment as described herein and as illustrated in the several figures of the drawings.

BEST MODE FOR CARRYING OUT THE INVENTION

The present invention is adapted to produce the conditions under which the invention described in the prior application of George G. Chadwick, Ser. No. 09/340,218 will operate efficiently. It is adapted to operate in an enclosed space and to operate in conjunction with the hub controller network and probe system set forth in the companion application, filed concurrently herewith. The disclosure, text and drawings of the earlier filed priority application, published as PCT/US00/11886, are specifically incorporated herein by reference. In addition, the present invention is closely related to, and operates in conjunction with, a hub and probe network, as described and shown in the application entitled "Hub and Probe System and Method", filed concurrently and incorporated by reference herewith.

Figure 1:
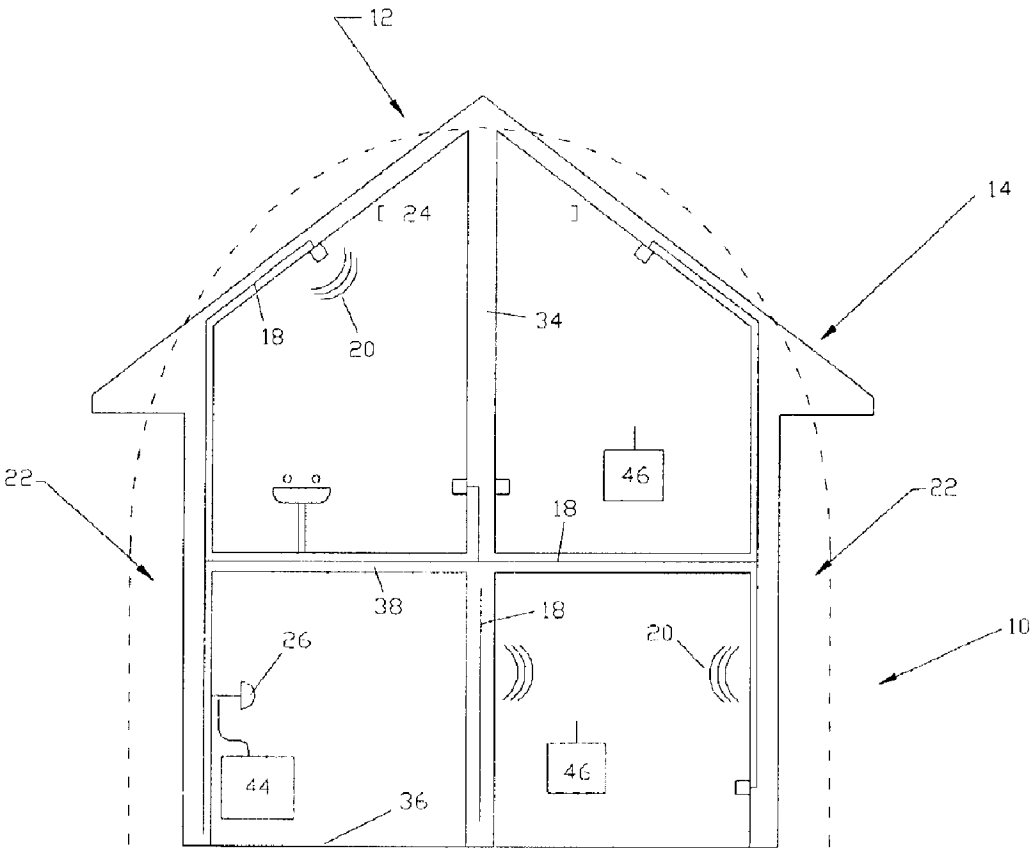
FIG. 1 is a schematic diagram of a typical structure having the operational communications system according to the inventor's technology, including an exciter system according to the present invention.

A presently preferred embodiment of the invention is an exciter device and a method of using the exciter device in an overall system to facilitate and optimize wireless communication within any of a variety of enclosed spaces. The preferred embodiment of the present invention is adapted to facilitate and work within the Electromagnetic Field Communication System for Wireless Networks set forth in the above referenced prior application, The presently preferred embodiment is referred to as a system for facilitating electromagnetic communications within an enclosed space (exciter system) and is designated herein by the general reference character 10. FIG. 1 illustrates the overall operation of the wireless network including the exciter system 10 in a typical building.

The exciter system 10 is adapted to operate in an enclosed space 12, which may be considered to be either a small space 14, such as a home or a small building or as a large space 16, as in a commercial office building or manufacturing area. The enclosed space 12 of either type must, in order to be suitable, include some variety of conductive framework 18 which can conductively "deliver" the energy placed into the conductive framework 18 throughout the enclosed space 12 to create a quasi static electromagnetic field 20 throughout the enclosed space 12. The framework 18 may be a single path, a convoluted path or a variety of conductive elements, all of which acting together form an electromagnetic virtual volume, akin to a "Faraday cage" which is referred to by the inventor as bubble 22. Typically, the conductive framework 18 is formed of the electrical wiring, the building plumbing system, metallic beams and girders and combinations of these elements.

The nature of the bubble 22 is roughly analogous to that of a cage or mesh which restrains electromagnetic waves much as a cage would restrain physical structures which are too large to fit between the bars. In this case, the conductive framework 18 forms virtual bars for waves with gaps 24 existing where no elements of the framework 18 are present. As long as the gaps in the conductive framework 18 are smaller than the effective dimensions of the field 20 the field will be "trapped" in the bubble 22 and will have little effect outside. This is especially important for purposes such as sensitive communications and also for compliance with various government regulations, such as FCC restrictions. The bubble 22 may actually include several semi-independent smaller spaces (rooms) each of which may function to some degree as a separate "cage", but which are related by the interconnected conductive framework 18 extending throughout the building.

The element which causes the conductive framework 18 to be energized in such a manner as to create the bubble 22 and provide the basis for wireless communication is an exciter 26. The exciter 26 in a particular enclosed space 12 will serve multiple functions. One of the principal functions, and the one from which the component is named, is the function of inducing the waveforms into the bubble 22. Exciters 26 of the types described herein are schematically shown and described in the earlier application as being the matching section.

The results obtained in actual building implementations are demonstrable and the system 10 is shown to function effectively in multiple environments. For the purposes of illustration, the exciter 26 and the exciter system 10 are described herein as exciting the building, thus setting up a non-propagating field on any desired frequency within the range of frequencies, with the non-propagating field acting to provide a "carrier" upon which the communications occur. In addition, the properties of the exciter 26, when properly installed within a building 12, create a special coupling with the conductive framework 18 of the building, such that signals induced in the conductive framework 18 at remote locations within the building 12 will be received in sufficient strength to be useful by the exciter component, provided that the signals are also within the frequency range. In this fashion, the same exciter component can function both as an "exciter" and a "listener".

Each exciter 26 will be of the same genera but those selected for a particular purpose have many variants in size, materials and packaging. Two specific examples of equally preferred embodiments are shown in the drawing and described herein, but the configuration may vary widely, depending on application. A hemispherical exciter 28 (also referred to as a 3-D exciter) is shown particularly in FIGS. 2, 3 and 4 while a planar sector exciter 30 (also referred to as a 2-D exciter) is shown particularly in FIGS. 5 and 6. The hemispherical 3-D exciter 28 is required for a larger commercial or industrial building (large space 16) while the smaller planar sector 2-D exciter 30 is more than adequate for a typical residence. Larger commercial buildings have sizes of 1860 $m^2$ (20,000 sq. ft) or more, while a typical residence has a size of less than 465 $m^2$ (5,000 sq. ft). The hemispherical exciter 28 has a larger size and surface area in order to provide a larger emanation frequency bandwidth, which is necessary in order to deliver enough energy at proper frequencies to the greater volume of the large space 16, while the 2-D exciter 30 is sufficient to operate in the small space 14.

The power required to estabish communications is related to the signal quality required and proportional to the overall volume of the structure, while the most significant dimension to the generation of the evanescent waves is the smallest axial distance between opposing conductive surfaces in each room of the structure. The local dimensions define the relevant cut-off frequency for the building (and the room) and are determinative in whether evanescent waveforms may be established in that room when the exciter function is performed.

Figure 3:
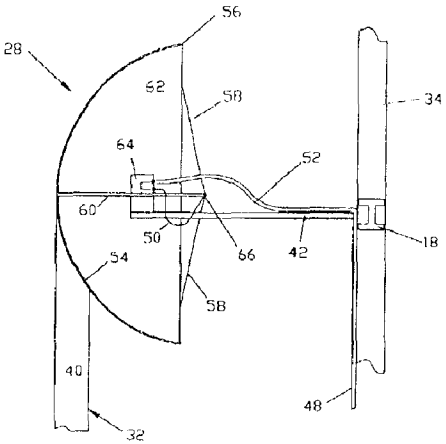
FIG. 3 is a vertical cross sectional view of a hemispherical exciter.
Figure 4:
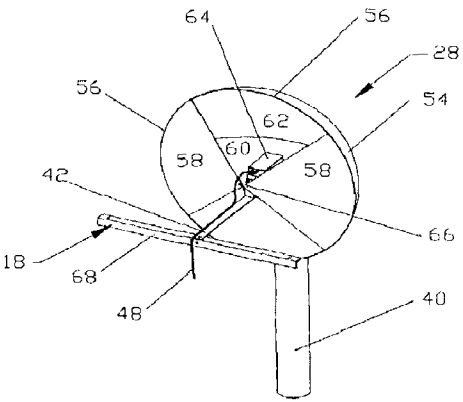
FIG. 4 is a perspective view of the hemispherical exciter of FIG. 3.
Figure 2:
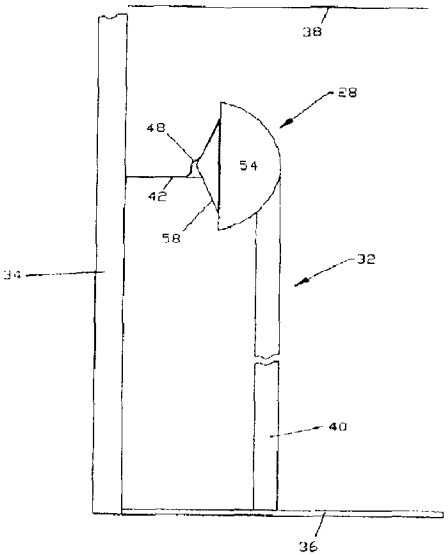
FIG. 2 is a side elevational view of an idealized hemispherical exciter, shown as installed on a cut-away portion of a structural wall.

The structure of the hemispherical exciter 28 is shown in FIGS. 2, 3 and 4, with FIGS. 2 and 3 illustrating the 3-D exciter 28 as installed for usage within a structure 12. The hemispherical exciter 28 is held in position by a physical support structure 32. For optimal effect, the exciter 26 should be installed in the interior of the particular enclosed space 12, preferably juxtaposed with an interior wall 34. The exciter 26 is preferably mounted approximately halfway intermediate the floor 36 and the ceiling 38, and directly opposite some component of the conductive frame 18. The physical support structure in this instance has two components, with the vertical support for the 3-D exciter 28 being provided by a post 40 while separation and additional support are provided by a spacer 42 connected to the nearby wall 34.

The post 40 and the spacer 42 are both formed of conductive materials. Further, the post 40 performs a functional purpose beyond merely being part of the physical support structure 32. Both the post 40 and the spacer 42 are provided with a dielectric insulator 43 at some location (in this embodiment adjacent to the floor in the case of the post 40 and at the point of connection to the exciter 28 for the spacer 42), in order to avoid providing a conductive electrical pathway between the exciter 28 and the electrical ground of the building. In the preferred embodiment, the post 40 is hollow and is constructed of a conductive metal, while the spacer 42 is a conventional metal bracket for strength.

The spatial dimensions relating to the placement and size of the exciter 26 are also significant to operation. For efficient operation, the exciter 26 should be mounted less than $\lambda/8$ (at the highest operating frequency) from the conducting wall element 18. In the illustration of FIG. 2, for use in a larger space 16 (an industrial building) the separation is 0.59 m (23.5 inches). In the room where the illustrated 3-D exciter 28 is mounted, which has a ceiling height of about 5.1 m (17 feet), the post 40 has sufficient length so that the center of the exciter 28 is spaced 2.55 m (8 feet 6 inches) above the floor 36. In the preferred embodiment the 3-D exciter 28 has a diameter of 0.6 m (2 feet) which is less than the restriction of a diameter less than $\lambda/8$ (at the highest operating frequency), in this case a frequency of 62.5 MHz (wavelength of 4.8 m). The post 40, also referred to as a curtain 40, has a diameter of 0.088 m (3.5 inches).

The exciter 26 is controlled and powered by a hub controller network system 44 (see FIG. 1). The hub system 44 provides energy within the desired frequency range in order to activate the exciter 26. The exciter 26 then energizes the conductive framework 18 as described in the earlier application so that the modulated signals generated by the hub controller network 44 may be received, translated and utilized by any of a number of probes or receivers 46 situated within the bubble 22 (see FIG. 1). In addition, in a "listening" mode, the exciter 26 acts to receive and conduct signals generated by the remote probes to the hub system 44. Both modes may operate simultaneously. Signals generated by the hub system and transmitted through the exciter 26 may be at different frequencies than the signals generated at remote locations and carried back through the conductive framework 18 to the exciter 26, and thence to the hub system 44. An alternative embodiment is for signals generated by the hub system and remote locations operate at the same frequency by time sharing transmissions.

In order to "excite" the building (the conductive framework 18), electromagnetic energy is injected by the hub controller 44 into a coaxial cable 48 having a center conductor 50 and a shield 52. The center conductor 50 is attached to the hemispheric 3-D exciter 28, while the shield 52 is electrically connected to the spacer 42, the conductive framework 18 and the wall 34. As seen in FIGS. 3 and 4, the shield 52 is directly electrically connected to the metallic structure within the wall 34. The energy delivered by the center conductor 50 does not radiate in normal fashion. The hemispheric two foot diameter 3-D exciter 28 is too small to radiate below 54 MHz. However, the exciter structure represents a significant discontinuity in this frequency range. The energy coupled into the center conductor 50 is almost entirely reflected but the energy that was in the shield 52 is now connected to the wall 34 forming the basis for the evanescent waves. Since the energy injected into the center conductor 50 is returned to the source, the reflected wave represents fifty percent (50%) of the input power. However, this reflected loss is essentially constant with frequency, because the remaining energy is almost totally transferred from the outside shield 52 to the structure of the wall 34.

The precise structure of the hemispheric exciter 28 is not critical, so long as it has an effective diameter of less than $\lambda/8$ (at the highest operating frequency) and is of sufficient size to establish a measurable shunt reactance to the incoming transmission line. This should not exceed 25% of the characteristic transmission line impedance. Depending on a number of empirical factors, different structures and exciter locations will have better effects within different buildings or other enclosed spaces 12. The particular 3-D exciter 28 utilized in the embodiment shown in FIGS. 2, 3 and 4 is shown to have a hollow hemisphere portion 54, also referred to as a bowl 54. The bowl 54 is constructed of a conductive material, and has a rim portion 56 at the edge. The conductive post 40 is directly connected (welded) to the bowl 54 in this embodiment. Extending outward and forward from the bowl 54, are a pair of conductive angularly derived sector members 58 (see, especially, FIGS. 3 and 4) which meet at the apices thereof and are connected to the rim 56 along their circumferential edges. A nonconductive acrylic bulkhead 60 extends laterally within a hollow interior 62 of the bowl 54 and abuts against the interior surfaces of the sector members 58, providing structural support thereto, and separating the hollow interior 62 into upper and lower halves.

Mounted within the hollow interior 62 and upon the surface of the acrylic bulkhead 60 is a matching circuit block 64. The matching circuit block 64 is connected to the coaxial cable 48, which runs along the spacer 42. The coaxial cable 48 is connected at its other end to the hub controller network 44 and carries the excitation current to the exciter 28 and directly to the matching circuit 64. The center conductor 50, or an extension thereof, then extends to a feed point 66 situated at the apices of the sector members 58 in order to conductively deliver the electrical signals from the hub network 44 to the exciter 28 (and to carry signals back to the hub 44 from the "listen" function of the exciter 26). The energy delivered to the feed point 66 then excites the conductive portions of the exciter, the sector members 58 and the hemispheric bowl 54, in a manner which excites the conductors in order to "attempt" to radiate across the effective bandwidth of the delivered signal. The characteristic of the exciter 26 at the selected frequencies, in light of the further connection of the shield of the coaxial cable to ground and to a metal framework 68 within the wall 34, does not permit normal propagational radiation however, and the net effect is the creation of the bubble 22 or evanescent and near evanescent waves in the conductive framework 18, as described herein.

The 3-D exciter is adapted for use in larger spaces 16 and has sufficient diameter and three-dimensional surface area to excite such a large volume and the extensive conductive framework 18 associated therewith. For smaller spaces 14, however, such a large surface area is not necessary. The 2-D planar sector 30 is sufficient for such volumes. The structure of the preferred planar sector exciter 30 is illustrated in top and cross sectional views in FIGS. 5 and 6 respectively.

Figure 5:
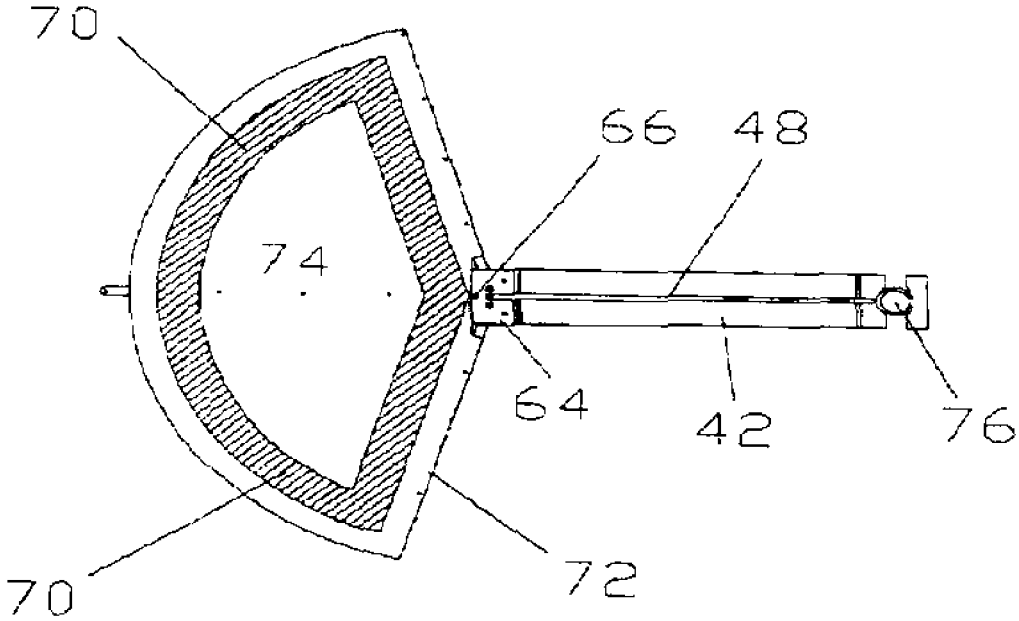
FIG. 5 is a top plan view of planar sector exciter, shown as installed upon a plumbing pipe.

It may be seen that the planar sector exciter 30 has only two effective dimensions and, as shown particularly in FIG. 5 is similar in shape to a cross section of the hemispherical exciter 28. That is, it includes a conductive broad trace 70 which corresponds in shape to the cross section of the portions of the bowl 54 and the sector members 58 of the 3-D exciter, taken along the plane of the bulkhead 60. The conductive trace 70 is laid out on a planar structural plate 72 which is formed of a nonconductive material, in order to support and electrically insulate the trace 70. A central zone 74, interiorly within the conductive trace 70 may either be empty space or a further portion of the nonconducting material of the structural plate 72, as needed for physical support. The structural plate 72 is supported by the spacer 42 in a manner similar to that of the 3-D exciter 28 and is maintained at the desired separation from the wall 34.

Figure 6:
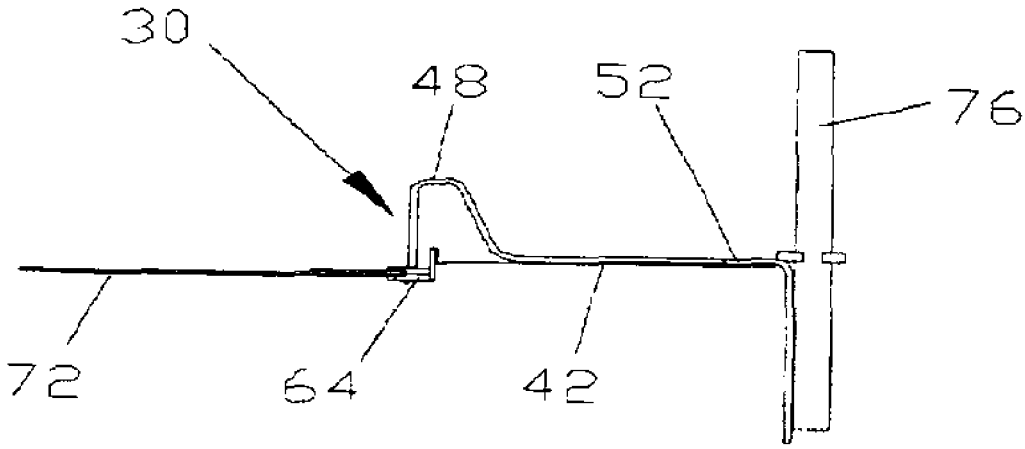
FIG. 6 is a side view of the planar sector exciter of FIG. 5.

The electrical structure of the planar sector exciter 30 is similar to that of the hemispherical exciter 28 in that it includes a matching circuit block 64 mounted on the structural plate 72 and delivering energy from the center conductor 50 of the coaxial cable 48 to the feed point 66, while the shield 52 is electrically connected along the spacer 42 to the conductive framework 18 situated within the wall 34. In the illustration of FIGS. 5 and 6, a plumbing pipe 76 forms the operant portion of the conductive framework 18.

Figure 7:
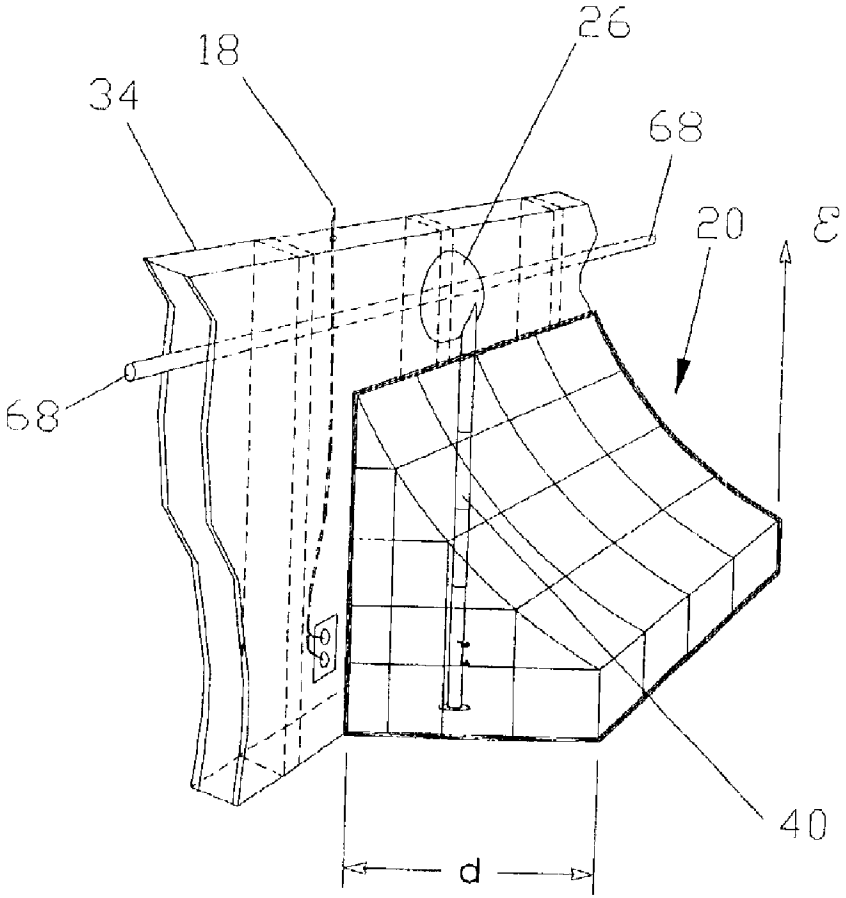
FIG. 7 is an illustration of the evanescent wave pattern induced in a structure by the use of the exciter invention.

FIG. 7 illustrates the evanescent wave established by the exciter 26 (in this case a hemispherical exciter 28) for use by a remote wireless receivers or probes 48 as described above. The magnitude of the evanescent wave pattern is schematically and graphically illustrated in order to show the relationship of the energy level $\epsilon$ as it corresponds to the distance d from the conductive framework 18 within the wall 34. It is noted that the illustration of FIG. 7 shows the exciter 26 being aligned with and in proximity to a portion of the conductive framework 18, and being electrically connected to such.

In the illustration, the segment of the framework 18 is a metal beam 68 similar to that of the illustration of FIG. 3. Another component of the conductive framework 18 shown is electrical wiring which may be present in the wall 34. This aspect of the drawing is used to illustrate that, even though the electrical wiring is not being directly excited by the exciter 26, it will nonetheless participate in the distribution of the waveforms throughout the structure of the bubble 22. It is certainly to be hoped that the electrical wiring in the building is not connected to the plumbing array, but yet both will be active, on the assumption that, at least at some locations, the separate conductive pathways are in reasonable proximity so that the evanescent waves directly introduced into one segment are carried into other parts of the structure by other independent conductive segments in a manner akin to induction.

Common applications do not require a precisely matched exciter 26. In most conventional systems, reflective losses are kept below 1 dB. However, in the case of the exciter 26, 3 to 6 dB of loss is reasonable because transmission losses are not as serious at frequencies below 100 MHz.

The supporting metallic post 40 serves another purpose in the case of the hemispheric 3-D exciter 28. The preferred post 40 has a diameter of 0.088 m (3.5 in) and a length (height) of 2.55 m (102 inches) and is spaced approximately 0.65 m (26 inches) from the excited wall 34. While this post member 40 constitutes a convenient support, it also serves a more pragmatic function. The discontinuity effect of the exciter 26 depends on the lowest frequency of operation. If the size of the exciter 26 is not at least five percent (5%) of the wavelength size, the discontinuity is too small. For example, the 2 foot diameter hemispheric exciter 28, while physically relatively large, is borderline at a sixty meter (100 foot) wavelength (10 MHz frequency). To extend the lower frequency of operation below this frequency requires a larger structure than the hemispheric exciter 28 by itself. This is accomplished by the vertical metallic post 40 or "curtain" which increases the discontinuity and extends the performance to a much lower frequency. It is noted that the post 40 is electrically a portion of the exciter 28 by being directly in contact with the hemispheric bowl 54 (see FIGS. 2, 3 and 4).

Figure 8:
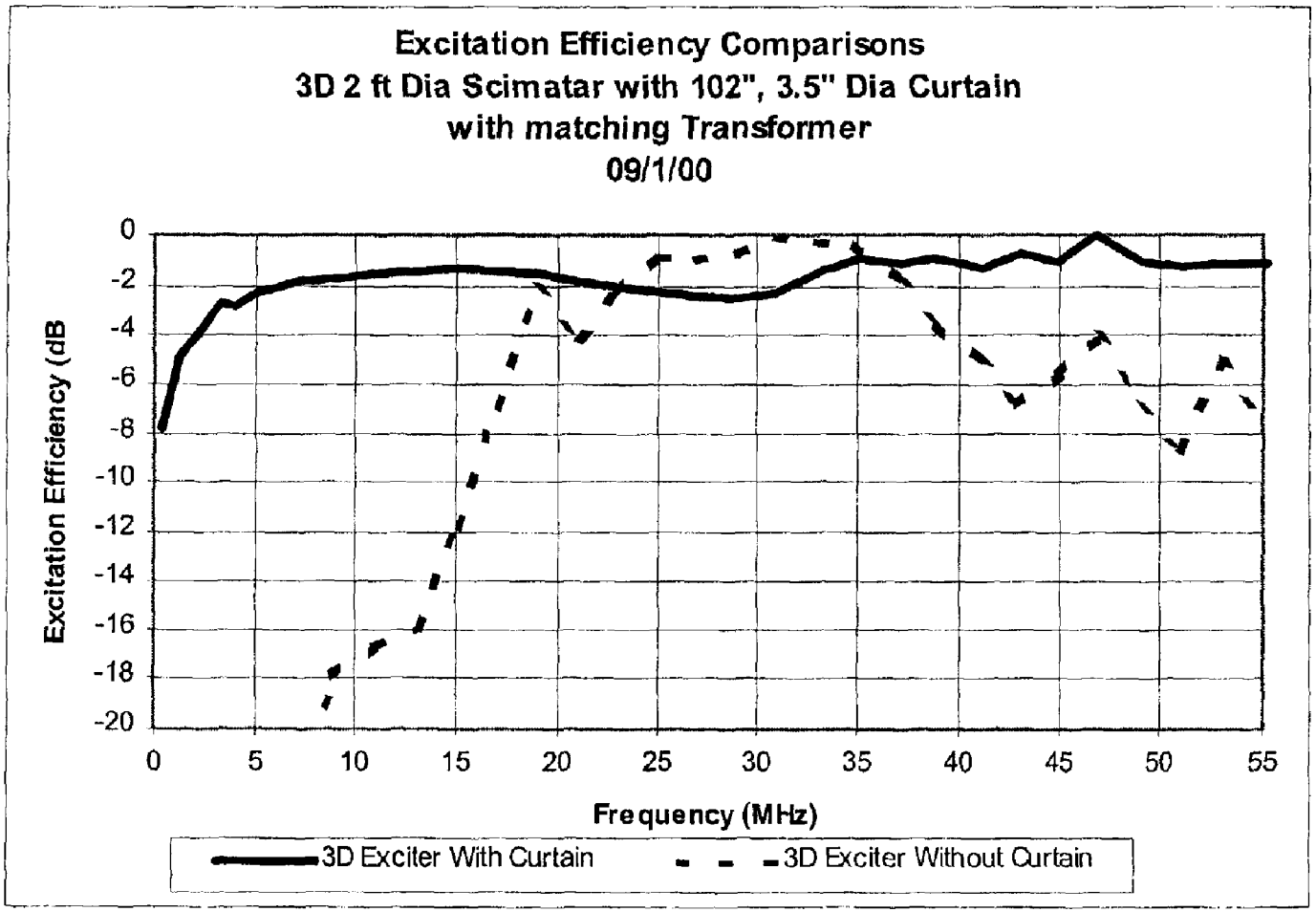
FIG. 8 is a graphical representation of excitation efficiency, showing the effect of the addition of a curtain element to the hemispherical exciter structure.

The impact of the size of this discontinuity is graphically illustrated in FIG. 8. This graph plots transmission efficiency as a function of frequency for both a simple hemispheric exciter 28 and the same exciter configuration with the addition of the vertical post member 40 as a curtain. The hemispheric exciter 28 with the curtain 40 has an efficiency of at least 50% above 3 MHz. When the curtain is removed, the efficiency drops significantly because the discontinuity is too small relative to the frequency of operation.

However, when the frequency increases and the wavelength reduces, there is now an upper limit on the size of the exciter. For example, in the 0.5 to 54 MHz region, evanescent characteristics are predominate below approximately 35 MHz. It is noted that this effect is measured in a large space 16, and that the characteristics are different where the room dimensions are smaller. At higher frequencies, even in smaller enclosed spaces, the cut-off effect is eventually eliminated because of the smaller wavelength and the propagation methodology is predominant. At 50 MHz, where the wavelength is about 6 m (20 feet), the size of the exciter should not exceed 0.75 m (30 inches) to stay below the performance limitation of one-eighth (⅛) of the wavelength.

Figure 9:
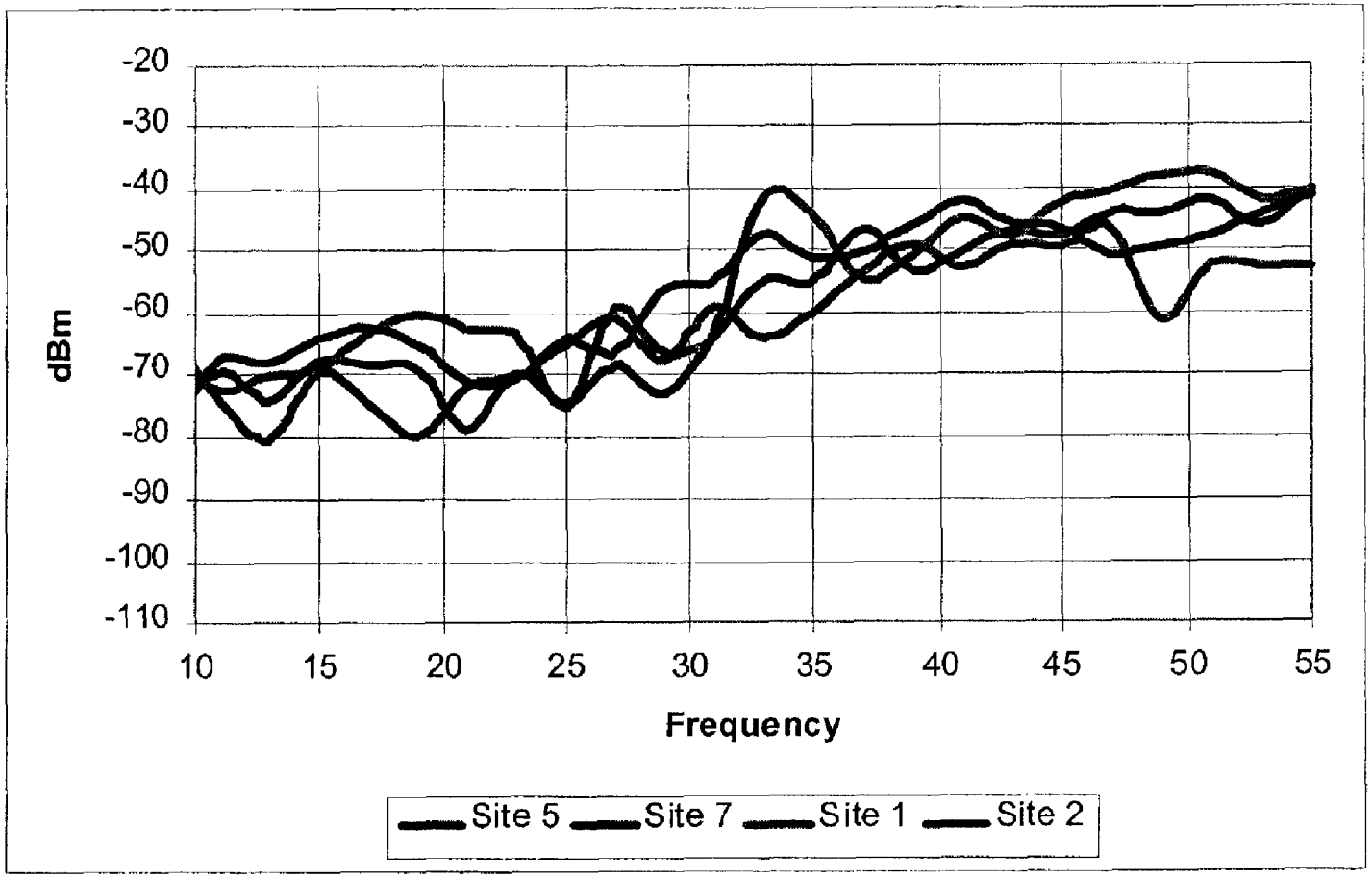
FIG. 9 is a graphical representation of measured results of the use of a hemispherical exciter within a building with relatively small minimal room dimensions.

An example of the measured results obtained in a 20,000 square foot single story commercial building are shown in FIG. 9. A 30 dBm source is injected into the exciter 28 and the amount of energy located at four (4) different sites throughout a commercial building is measured and graphically depicted. Similar results have also been obtained for eight (8) sites within this commercial building.

Figure 10:
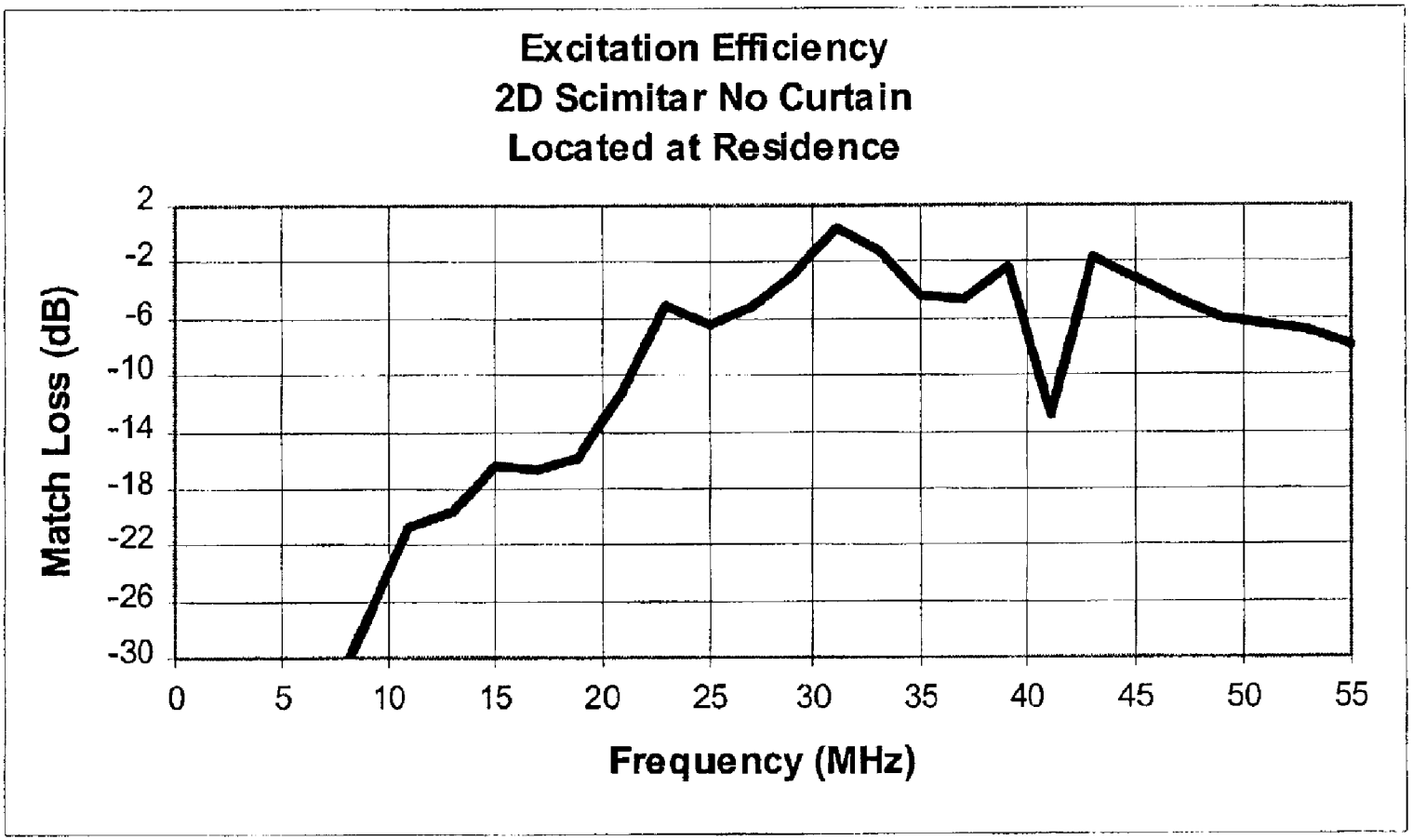
FIG. 10 is a graphical illustration of excitation efficiency of an actual planar sector exciter in use in a small space.

The illustration of FIG. 10 is similar to that of FIG. 8 and shows the measured excitation efficiency of a planar sector exciter 30 installed within a small space 14, in this case a residence having a size of less than 5000 square feet. The efficiency is seen to be adequate for frequencies above 15 MHz, even without a curtain 40.

Characteristics of buildings will differ and each enclosed space requires some empirical adjustment in order to properly locate and mount the exciter 26. However, for most buildings, or even other types of structures which are effectively enclosed spaces 12 with respect to waves in the selected frequencies, the exciter structures describes herein will be efficacious in energizing and creating the bubble 22 effect. The inventor has successfully transmitted streaming video over data links operating at eleven megabits per second (11 Mbps).

Within the parameters set forth, the precise physical shapes and dimensions of the exciters may be varied, and different materials may be utilized while still resulting in functional operations. The spacing between the exciter element and the conductive framework may be varied within acceptable ranges and the manner of delivering the energy to the exciter may be varied. Those skilled in the art will no doubt be able to develop related structures and utilizations without undue experimentation.

In addition to the above mentioned examples, various other modifications and alterations of the system and method may be made without departing from the invention. Accordingly, the above disclosure is not to be considered as limiting and the appended claims are to be interpreted as encompassing the entire spirit and scope of the invention.

INDUSTRIAL APPLICABILITY

The exciter system 10 of the present invention is applicable industrially and commercially primarily in connection with the inventor's Electromagnetic Field Communications System for Wireless Networks. This is a wireless technology scheme which allows wireless communication within a structure. In a typical residential, commercial or industrial building, the exciter 26 performs the function of exciting the metallic elements (conductive framework 18) of the wall whether they be electrical wires, metal walls, plumbing or any combination thereof This wireless system 10 is initiated by a hub controller network 44 which is connected to the exciter. The exciter in turn energizes the conductive framework in the walls of the enclosed space 12 for use by one or more remote wireless receivers 46. The overall aspects of this technology are described in U.S. patent application-MGC9901 entitled Electromagnetic Field Communications System for Wireless Networks dated Jun. 25, 1999. The network along with the exciter allows a complete wireless system to operate within a structure that would otherwise not be possible. The technology uses the metallic elements within the walls to create the evanescent modes which also prevents radiation from within the structure to the outside, and prevents galactic noise from penetrating into the structure.

The exciter serves the purpose of exciting a structure which allows the referenced network to be implemented. Conventional propagation in the lower frequency bands is severely restricted by cut-off effects within a structure and other connectivity methods must be developed to implement an efficient wireless network. This connectivity method utilizes evanescent modes (waves). The exciter allows the coexistence of both conventions, evanescent, and conventional propagation. When the frequency of operation and structure size are such that conventional propagation cannot exist, non-propagating evanescent modes are generated.

The metallic construction or conductive framework 18 of the structure may include plumbing, wires, metal ducts or any other type of metallic elements. The only difference between a typical residential, commercial or industrial structure is the size and type of metallic elements within the structure. Frequencies below 20 MHz in all of the example above are below cut-off and little or no propagation occurs within the structure. Some other method of connecting RF energy must be developed for wireless connectivity within the structure. This alternative method uses evanescent waves. In the most simple of descriptions, if energy is coupled into a metallic boundary and it cannot radiate (as in the cut-off case), it will establish electromagnetic fields. These fields are referred to as evanescent and their operation is discussed above.

When used in conjunction with the hub system 44 and the remote device probes 46, the exciter system 10 provides a significant portion of the communication pathway between these elements. Typically the hub system may wish to send a signal which may be received and interpreted by one or more of the remote devices. The hub system will then deliver a signal to the exciter 26 at a selected first frequency within the evanescent frequency range for the building. This will cause the exciter 26 to "excite" the conductive framework in a manner which generates the evanescent wave field (See FIG. 7) at that first frequency throughout the building, with a similar effect being observable near any portion of the conductive framework 18. Any of the remote probes 46 situated in proximity to the conductive framework 18, and attuned to the first selected frequency, will then couple to the filed and receive the selected information.

In "listen" mode the remote probes 46 will generate a signal at a second selected frequency. This signal will be carried by the conductive framework 18. As the invention is presently understood, the exciter, due to its structure and placement, has a special degree of coupling to frequencies within the range. Thus, if the second selected frequency is within the desired range, the exciter 26 acts as a receiver and carries the signal (which would otherwise be far too weak for ordinary reception) at a signal strength sufficient for receipt and processing within the hub network.

Once installed, the exciter system 10 can be utilized in a wide variety of ways, depending on the other components installed therewith. The exciter system 10 is primarily a conduit and facilitation for the communication between whatever is connected to the hub network 44 and whatever types of remote units and probes 46 that are desired. This variety is described in the companion application. This provides nearly infinite variety of usages in a wide variety of communication schemes and in different types of enclosed spaces, from huts to ocean liners.

For the above, and other, reasons, it is expected that the exciter system 10 of the present invention will have widespread industrial applicability. Therefore, it is expected that the commercial utility of the present invention will be extensive and long lasting.

What is claimed is:

1. An exciter system for inducing evanescent waves within an enclosed structure including a conductive framework, the system comprising:

an exciter device situated with the structure and in proximity to a portion of the conductive framework, the exciter being directed toward said portion of the conductive framework;

means for exciting said exciter at a frequency so as to induce evanescent waves within the conductive framework.

2. The exciter system of claim 1, wherein said exciter is spaced apart from said portion of the conductive framework by a distance of less than $\lambda/8$ where $\lambda$ is the wavelength corresponding to the highest frequency at which said excited is intended to be excited by said means for energizing.

3. The exciter system of claim 1, wherein said exciter has an effective diameter of conductive portions which is less than $\lambda/8$ where $\lambda$ is the wavelength corresponding to the highest frequency at which said excited is intended to be excited.

4. The exciter system of claim 1, wherein said portion of the conductive framework opposing said exciter is associated with a wall of the structure and said exciter is situated approximately equally spaced between the associated floor and the ceiling.

5. The exciter system of claim 1, wherein energy is delivered to said exciter through a coaxial cable, with a center conductor of said coaxial cable being electrically connected to said exciter and a shield portion of said coaxial cable being electrically connected to ground through said portion of the conductive framework.

6. The exciter system of claim 1, wherein said exciter is a hemispherical exciter unit, including a conductive bowl portion, and one or more angularly derived sector portions.

7. The exciter system of claim 6 wherein at least two of said angularly derived sector member are provided, each said angularly derived sector member being electrically connected to said conductive bowl along the rim thereof and all of said angularly derived sector members meeting at a common feed point situated approximately on an axis of said hemispherical exciter; and energy is delivered to said exciter though a coaxial cable, with a center conductor of said coaxial cable being electrically connected to said feed point and a shield portion of said coaxial cable being electrically connected to ground through said portion of the conductive framework.

8. The exciter system of claim 1 and further including a curtain member conductively attached to said exciter for effectively increasing the size thereof and enhancing performance at low frequencies.

9. The exciter system of claim 1 wherein:

a conductive component of said conductive framework is situated within a wall of the enclosed space;

said exciter is held in a position spaced apart from said conductive component by a spacer; and excitation energy is delivered to said exciter along one portion of an electrical circuit while a second side of said electrical circuit is connected to said conductive component situated opposite said exciter.

10. A method for inducing evanescent waves in a conductive framework in an enclosed space, comprising:

locating a portion of the conductive framework within a wall of the structure, and selecting a segment which is situated approximately equally intermediate at the upper and lower extents of said wall;

mounting an exciter at a location opposite said segment, and separated therefrom by a separation distance; and exciting said exciter at a frequency or multiple frequencies within a range, said range being characterized such that the upper extent thereof has a wavelength greater than the cut-off wavelength determined for the particular enclosed space.

11. The method of claim 10 wherein said separation distance is less than $\lambda/8$ where $\lambda$ is the wavelength corresponding to the highest frequency within said range.

12. The method of claim 10 wherein said exciter has an effective diameter of conductive portions which is less than $\lambda/8$ where $\lambda$ is the wavelength corresponding to the highest frequency within said range.

13. The method of claim 10 wherein the evanescent waves induced in the conductive framework are caused to be modulated at selected frequencies within said range so as to carry information thereon to devices attuned to said selected frequencies.

14. The method of claim 10 wherein said exciter is excited by delivering excitation energy thereto in a magnitude determined for the particular enclosed space such that the evanescent waves are detectable at usable levels throughout the enclosed space.

15. An exciter for use in conjunction with a conductive framework in an enclosed space, comprising:

a conductive element having a cross sectional shape of a semicircle, having a rim portion with the open side of said semi-circular element facing a portion of said conductive framework;

angular conductors extending from said rim portion to a feed point situated intermediate from said conductive element and said conductive framework; and signal circuitry having one side thereof connected to said feed point and the other side thereof connected to said conductive framework.

16. The exciter of claim 15 wherein said conductive element is in the form of a hemispherical conductor and said angular conductors are in the form of a pair of angularly derived sectors.

17. The exciter of claim 15 wherein said conductive element and said angular conductors are in the form of a conductive trace arrayed on a planar surface.

18. The exciter of claim 15 and further including a conductive curtain conductively attached to said conductive element to increase the effective size thereof and to enhance effectiveness at lower frequencies.

19. The exciter of claim 15 and further including a spacer, electrically isolated from the exciter, for supporting the exciter at a separation distance from said conductive framework, said separation distance being selected for optimizing a sensitized relationship between the exciter and said conductive framework, such that electromagnetic waveforms within a dimensionally determined frequency range for the enclosed space are preferentially exchanged between the exciter and the conductive framework.

20. The exciter of claim 19 wherein the exciter operates in an exciter mode when said signal circuitry is utilized to carry excitation current to the exciter so as to induce waveforms in said conductive framework; and the exciter operates in a listener mode when waveform signals within said dimensionally determined frequency range carried in said conductive framework are delivered by the exciter through said signal circuitry.

* * * * *